United States Patent [19]

Agbede

[11] Patent Number: 5,010,694

[45] Date of Patent: Apr. 30, 1991

[54] FLUID CUTTING MACHINE

[75] Inventor: Robert O. Agbede, Monroeville, Pa.

[73] Assignee: Advanced Technology Systems, Inc., Monroeville, Pa.

[21] Appl. No.: 388,151

[22] Filed: Aug. 1, 1989

[51] Int. Cl.[5] ..... B24C 3/06

[52] U.S. Cl. ..... 51/429; 51/241.5; 51/241 B; 51/410; 51/436

[58] Field of Search ..... 51/241 S, 241 B, 439, 51/427, 319, 317, 410, 428, 436, 413, 410, 420, 230, 292, 436, 439, 241 R, 428; 239/373; 30/95, 96, 97, 93

[56] References Cited

U.S. PATENT DOCUMENTS

| | | | |
|---|---|---|---|
| 2,618,915 | 11/1952 | Johnson | 51/241 S |
| 2,914,891 | 12/1959 | Nix | 51/241 B |
| 3,709,409 | 1/1973 | Collins | 239/373 |
| 3,722,778 | 3/1973 | Rohrberg et al. | 30/95 |
| 3,953,941 | 5/1976 | Kuhn et al. | 51/319 |
| 3,994,097 | 11/1976 | Lamb | 51/427 |
| 4,116,382 | 10/1978 | Clerk | 239/373 |
| 4,135,669 | 1/1979 | Bridges et al. | 239/373 |
| 4,384,675 | 5/1983 | Jacobs | 239/373 |
| 4,478,368 | 10/1984 | Yie | 51/439 |
| 4,483,106 | 11/1984 | Wachs et al. | 51/241 S |
| 4,555,872 | 12/1985 | Yie | 51/439 |
| 4,631,003 | 12/1986 | Chamberlin et al. | 239/373 |
| 4,648,215 | 3/1987 | Hashish et al. | 51/439 |
| 4,711,056 | 12/1987 | Herrington et al. | 51/439 |
| 4,756,481 | 7/1988 | Leuenberger | 239/373 |

FOREIGN PATENT DOCUMENTS

| | | | |
|---|---|---|---|
| 1185555 | 3/1970 | United Kingdom | 51/317 |

*Primary Examiner*—Frederick R. Schmidt
*Assistant Examiner*—Mark A. Morris
*Attorney, Agent, or Firm*—Niles H. Ljungman & Associates

[57] ABSTRACT

A mobile platform in an underground mine supports an electric motor that operates a compressor to supply air under pressure to one or more hoppers containing abrasive particles which are held in suspension and pressurized within the hopper. The electric motor is drivingly connected to a hydraulic pump that supplies water under pressure in a range of 3000 to 4000 p.s.i. through a conduit to the water inlet of a nozzle assembly. A second conduit conveys the pressurized abrasive particles to the nozzle assembly for admixture with the water. The flow of abrasive particles is maintained by the compressed air at a constant flow rate to enhance the output velocity of the water encapsulated particles from the nozzle assembly. The abrasive stream impinges on the surface of a gas well casing to sever the casing as the nozzle assembly is rotated around the casing. In this manner a pipe or gas well casing obstructing a mining operation is removed without generating sparks in the hazardous mine atmosphere.

19 Claims, 11 Drawing Sheets

FLUID CUTTING MACHINE

BACKGROUND OF THE INVENTION

1. Field of the Invention

This invention relates to method and apparatus for cutting gas well casings in the explosive environment of an underground coal mine and more particularly to a cutting nozzle assembly for generating a three phase high velocity coherent stream of air and abrasive particles mixed with water for cutting metal pipe without generating sparks.

2. Description of the Prior Art

In underground mining operations it is not uncommon in dislodging a seam of coal to encounter a gas well casing that extends down to the coal seam. If the dislodging means of a mining machine, such as the cutting scroll of a longwall mining machine, should come in contact with the metal casing, the sparks that are generated and the associated heat could cause an explosion if there is the requisite concentration of methane gas in the working environment. In many instances the gas well pipe is charted on the mining maps but it is not uncommon to encounter an uncharted gas well casing. In such an instance the mining machine must be removed from the face before it contacts the casing and arrangements made to remove the casing in a safe manner.

Water jet cutting nozzles are well known in the art as disclosed in U.S. Pat. Nos. 4,545,157; 4,648,215; 4,478,368; 4,707,952 and 4,723,387. With each of these devices pressurized water and a stream of abrasive particles are introduced separately into the mixing chamber of a cutting nozzle. The high velocity jet of water comes in contact with the abrasive particles and momentum is transferred from the water to the particles to form a high velocity stream of abrasive particles entrapped within the stream of water that exits the cutting tip of the nozzle assembly. The abrasive water jet stream is then used in a variety of cutting operations, such as cutting rock, concrete, asphalt and metals such as reinforcing rod.

A problem that is encountered with the cutting of metal by water jet abrasives is the generation of sparks. In a hazardous environment, such as underground coal, the presence of methane in the atmosphere can create an explosion when sparks are generated by the action of cutting with abrasives even in a water jet slurry where the abrasive particles are relatively large.

While it is known to cut metal with abrasive particles encapsulated in a fluid jet stream, the known water jet cutting nozzles do not satisfactorily eliminate the hazard of sparking when cutting metal such as gas well casing in an underground mine.

Therefore, there is need for a fluid cutting machine that is adaptable for use in cutting metal in an underground mine and other similar hazardous environments where sparking is eliminated. The fluid cutting machine, when not in use to cut gas well casings in advance of the mine machine, should also be available to perform other cutting tasks, such as drilling bore holes in the mine roof for installation of mine roof support devices and for coal dislodging operations.

SUMMARY OF THE INVENTION

In accordance with the present invention there is provided a fluid cutting machine that includes a supply of abrasive particles supported for advancement to a selected location in underground mine adjacent a gas well casing to be severed. The abrasive particles are pressurized at the outlet point where the particles are conveyed in an air stream through a feed line to a cutting jet assembly. Power means actuates a compressor to maintain the particles pressurized in a suspended state to insure uniform flow of the particles to the cutting jet assembly. The abrasive particles and air mixture enter the cutting jet assembly and are admixed therein with a flow of water under pressure. A hydraulic pump is actuated by power means to establish flow of water at a pressure which encapsulates the abrasive particles within the cutting jet assembly. The water encapsulated particles are conveyed in a stream from the jet assembly at a pressure sufficient to sever the gas well casing without generating sparks and igniting combustible gas which may be present in the mine atmosphere.

Accordingly, the principal object of the present invention is to provide method and apparatus for severing gas well casing and the like in an underground mine without creating ignition of combustible gas in the mine.

Another object of the present invention is to combine a high pressure jet stream and pressurized flow of abrasive particles in a jet assembly so that the particles are encapsulated with water but conveyed at a velocity and force sufficient to cut metal through momentum transfer.

A further object of the present invention is to provide apparatus for generating a high velocity jet stream at a pressure in the range 3000–5000 p.s.i. combining air, water, and abrasive particles for cutting solid material including rock, mineral deposits, and metal.

These and other objects of the present invention will be more completely disclosed and described in the following specification, the accompanying drawings and the appended claims.

DESCRIPTION OF THE PREFERRED EMBODIMENTS

Figure 1:
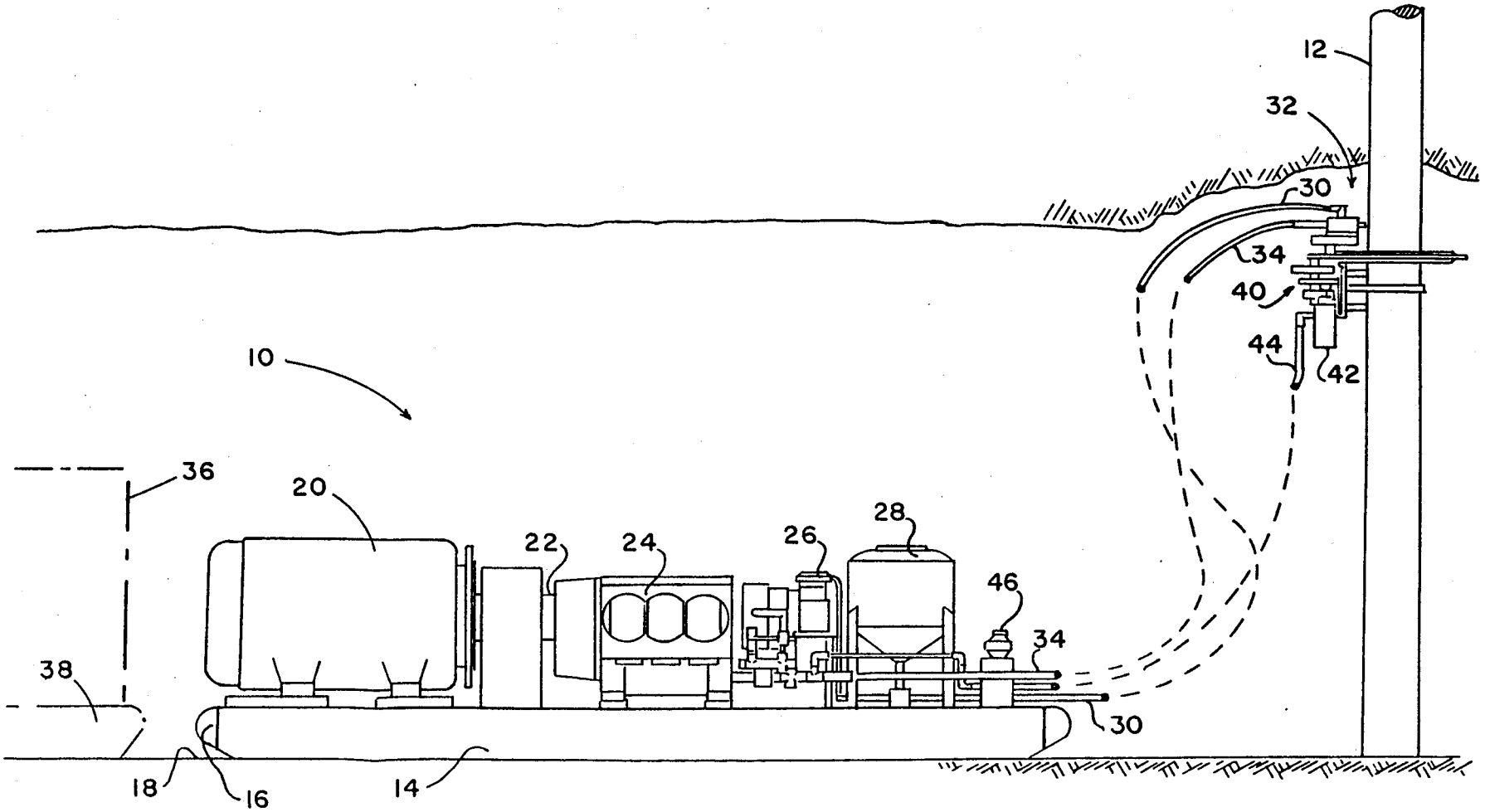
FIG. 1 is a schematic illustration of a fluid cutting machine for use in cutting gas well casings from a coal seam in advance of the mining machine.

Referring to the drawings and particularly to FIGS. 1–4, there is illustrated a fluid cutting machine generally designated by the numeral 10 for use in an underground mine to sever or cut gas well casing or pipe 12 that extends through a mineral seam. The cutting machine is supported on a mobile frame 14 so as to be easily movable throughout a mine and can be moved in position in advance of a mining machine to permit cutting and removal of the pipe 12 in advance of the mineral dislodging operation. Preferably the operation of the fluid cutting machine is readily adaptable to the existing services in an underground mine and with the other underground mining equipment. For example, the electrical, hydraulic and water sources in the mine are usable by the machine 10. Thus the machine 10 is designed to use existing levels of water volume and pressure available throughout the underground mine and may be coupled directly into existing mine equipment, such as a roof support pump, roof support equipment, a roof bolter and many other pieces of equipment that are commonly utilized in mining operations.

The movable platform 14 is preferably constructed of skids 16 so as to facilitate movement of the machine 10 along the mine floor 18. However, it should be understood that any suitable means may be utilized for transporting the cutting machine 10 to the desired location in the mine.

The principal source of power for the fluid cutting machine 10 is an electric motor 20 which is securely mounted on the rearward end portion of the mobile frame 14. The motor 20 includes a drive shaft 22 which is connected to the input of a hydraulic motor 24. The hydraulic motor 24 is in turn connected through the crankshaft of the hydraulic motor to an air compressor 26 where the hydraulic pump and compressor are also mounted on the mobile frame 14. The air compressor 26 is connected in a manner to be described later in greater detail and illustrated in FIGS. 3 and 4 to a hopper 28 containing abrasive particles to be used in the pipe cutting operation. The air compressor, through a series of conduits and valves shown in greater detail in FIGS. 3 and 4, supplies air under pressure to the hopper 28 to charge the hopper with compressed air to insure a steady flow of the particles from the hopper 28 through feed line or conduit 30 to a nozzle assembly 32.

Figure 2:
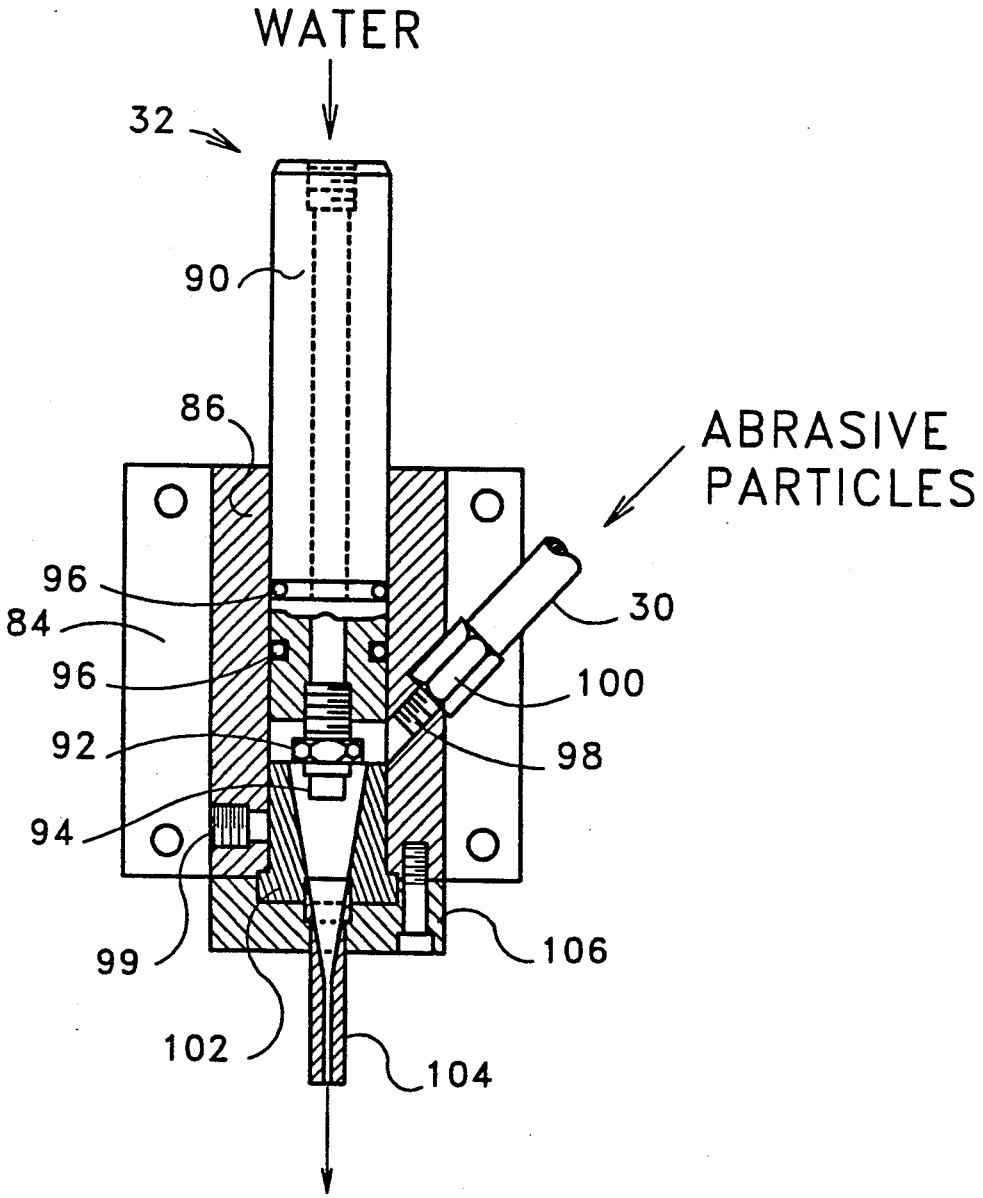
FIG. 2 is an enlarged fragmentary sectional view of the nozzle assembly for the fluid cutting machine shown in FIG. 1.
Figure 2A:
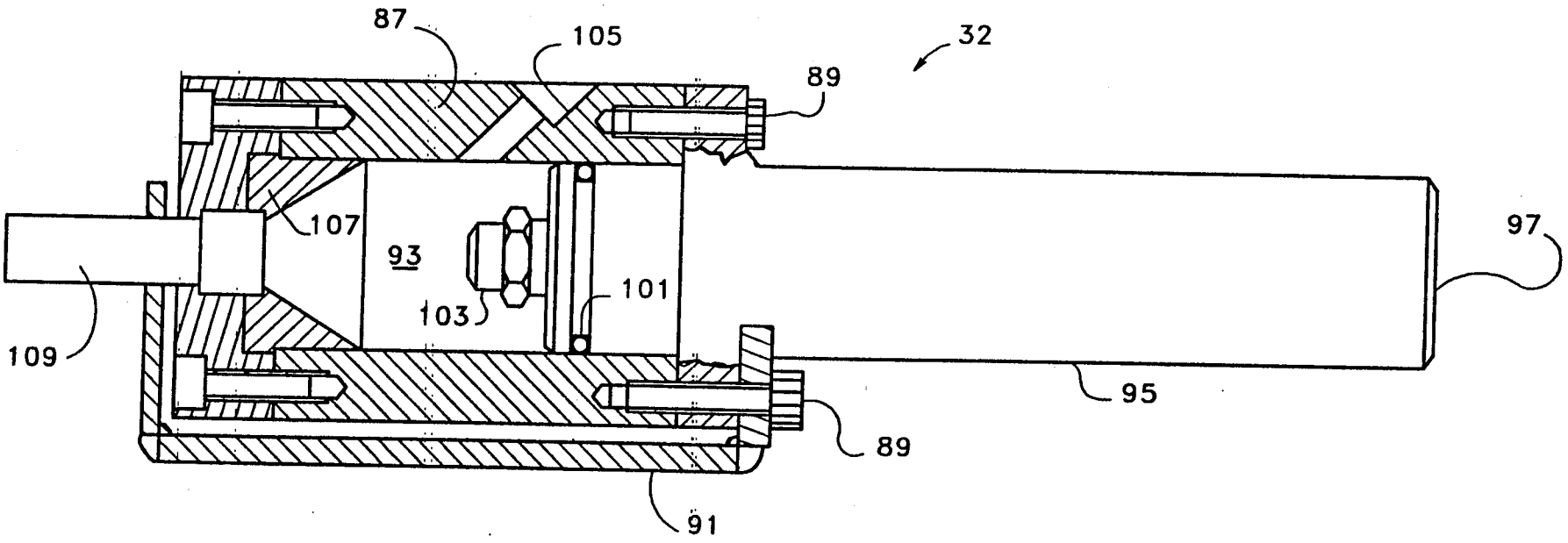
FIG. 2A is an enlarged fragmentary sectional view of another embodiment of the nozzle assembly.

The nozzle assembly 32, as illustrated in FIG. 1 and in greater detail in FIGS. 2 and 2A also receives through conduit or high pressure feed line 34 fluid under pressure from hydraulic pump 24. The assembly 32 is thus remotely positioned from the mobile frame 14, for example, over 200 feet from the mobile frame 14. The fluid, which could be an emulsion of water and oil, is stored in a tank 36 which may be also mounted on a mobile frame 38 adjacent the mobile frame 14. Preferably the water is conveyed by the pump 24 through the feed line 34 to the nozzle assembly 32 at a pressure in the range between about 3000–5000 p.s.i. This pressure is commonly used in underground mining operations and therefore when the nozzle assembly 32 is not in use, the hydraulic pump can be used for other functions in the mine.

Figure 6:
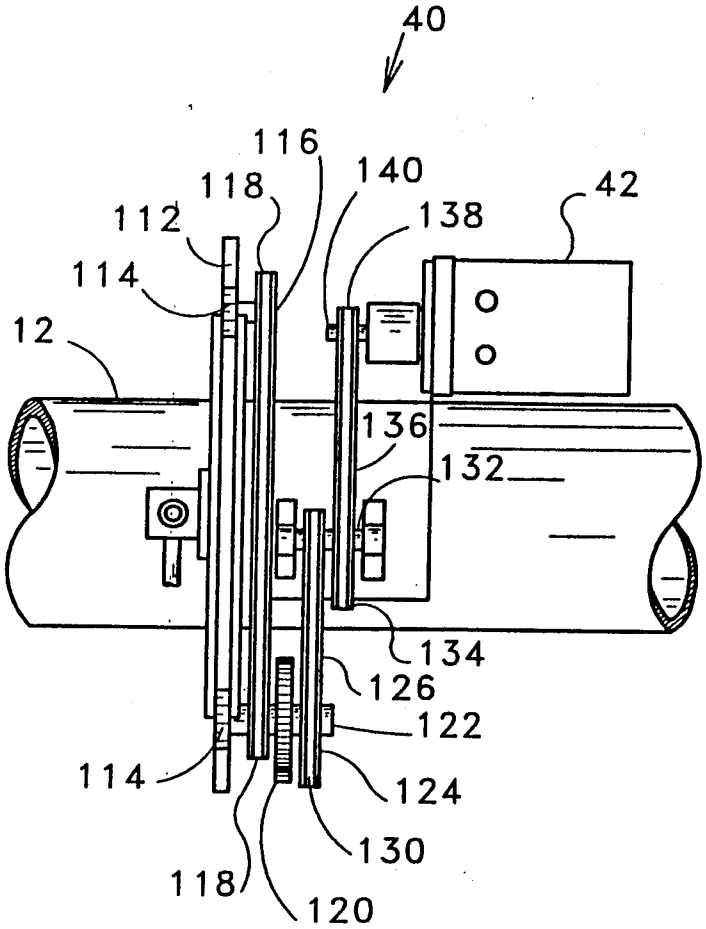
FIG. 6 is a view in side elevation of the gear drive shown in FIG. 5.
Figure 5:
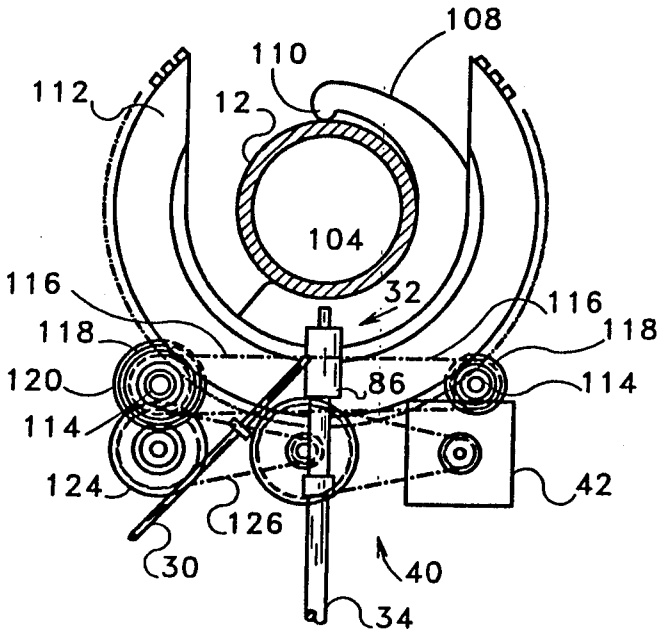
FIG. 5 is a top plan view of the gear driven manipulator for advancing the fluid cutting nozzle around the periphery of the metal pipe to be cut.
Figure 7:
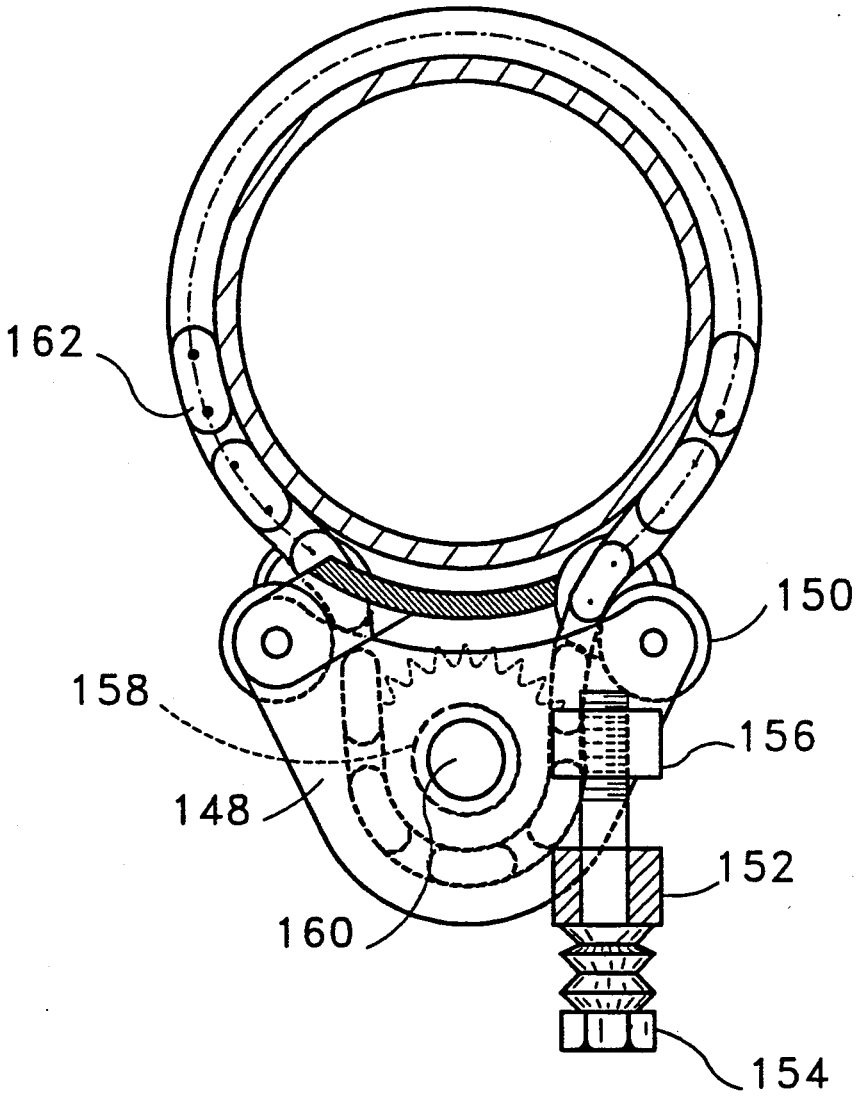
FIG. 7 is a plan view of a roller-mounted embodiment for advancing the manipulator.
Figure 8:
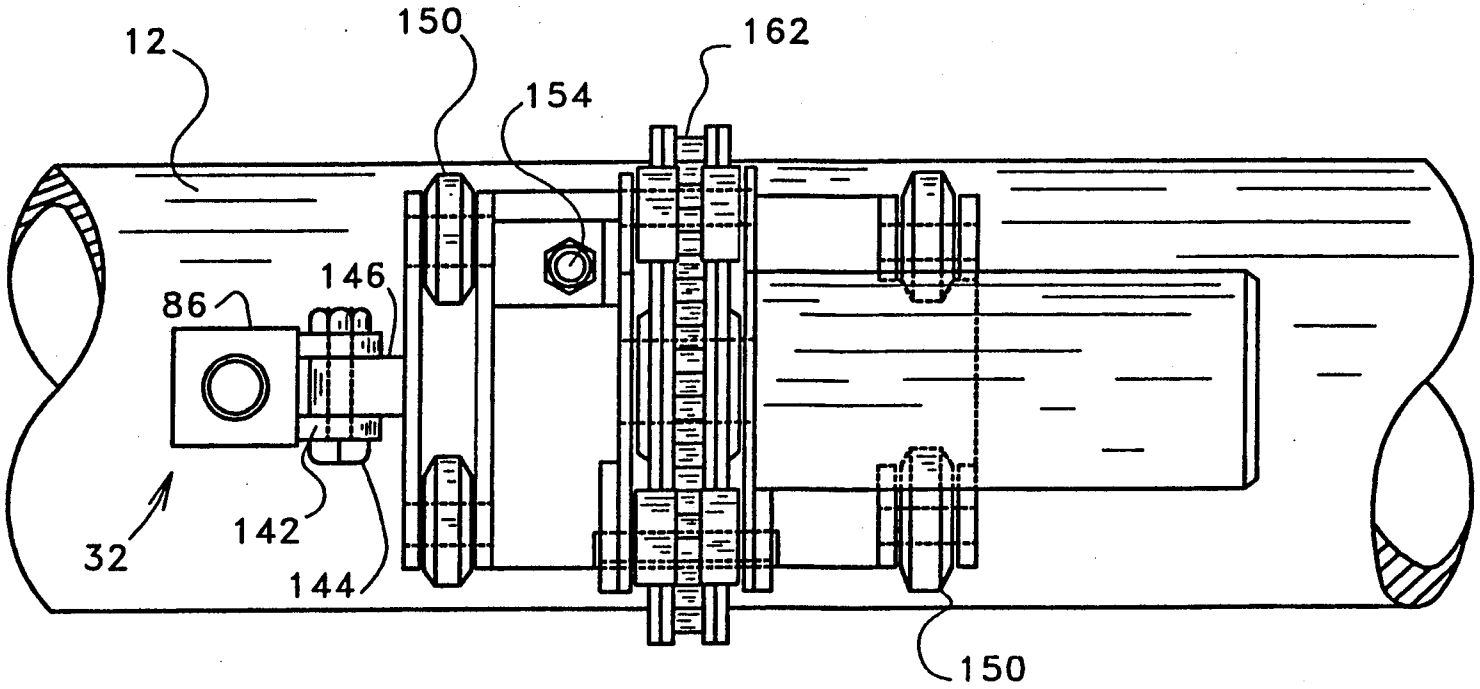
FIG. 8 is an end view of the manipulator shown in FIG. 7.
Figure 10:
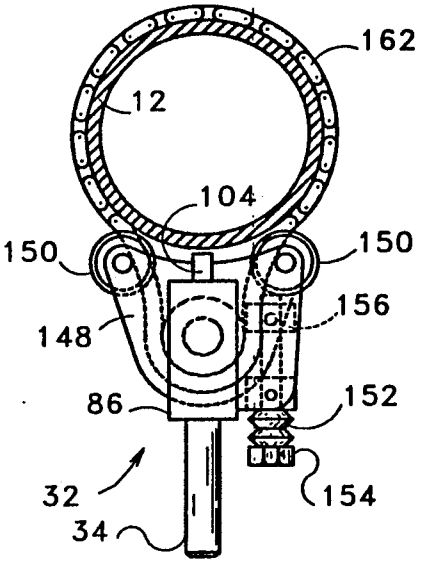
FIG. 10 is a sectional view of the manipulator taken along line X—X of FIG. 9.
Figure 9:
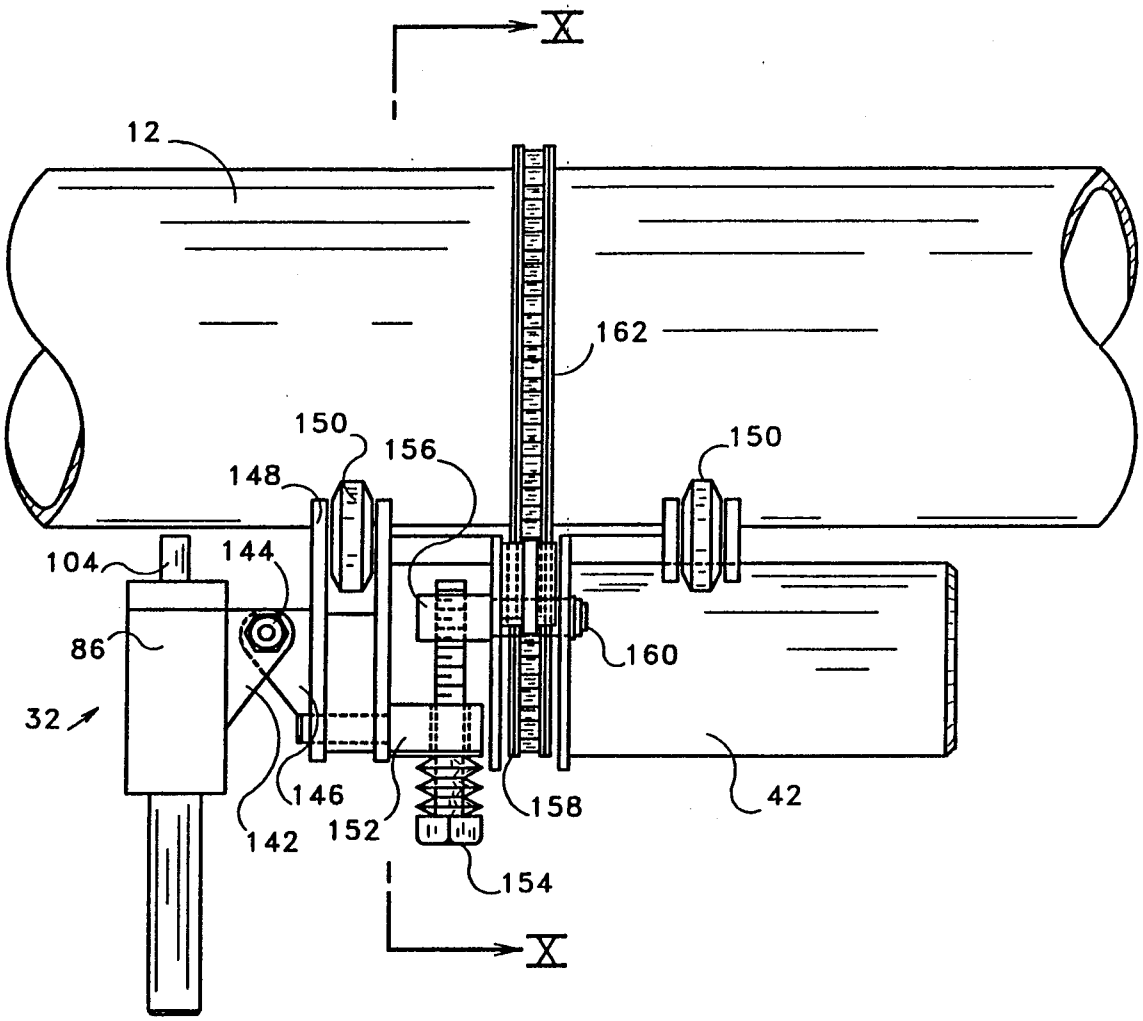
FIG. 9 is another view of the manipulator shown in FIG. 7.

The cutting jet assembly, as will be explained later in greater detail, is suitably mounted on the pipe 12 for circumferential movement around the pipe at a rate selected to permit cutting of the pipe based on the thickness of the pipe and the pressure and volume at which the abrasive encapsulated in the high pressure water stream cuts the pipe to sever the pipe. A manipulator assembly, generally designated by the numeral 40, controls the movement of the nozzle assembly 32 around the pipe and maintains positioning of the pipe for cutting perpendicular to the longitudinal axis of the pipe. One embodiment of the manipulator 40 is shown in FIGS. 5 and 6 and a second embodiment of the manipulator 40 is shown in FIGS. 7 and 8. With each embodiment of the manipulator 40, a hydraulic drive motor is connected to a drive train which advances the cutting jet assembly around the pipe. The hydraulic drive motor 42 is connected by a conduit or feed line 44 through a pressure reducing valve 46 to the hydraulic pump 24.

Figure 3:
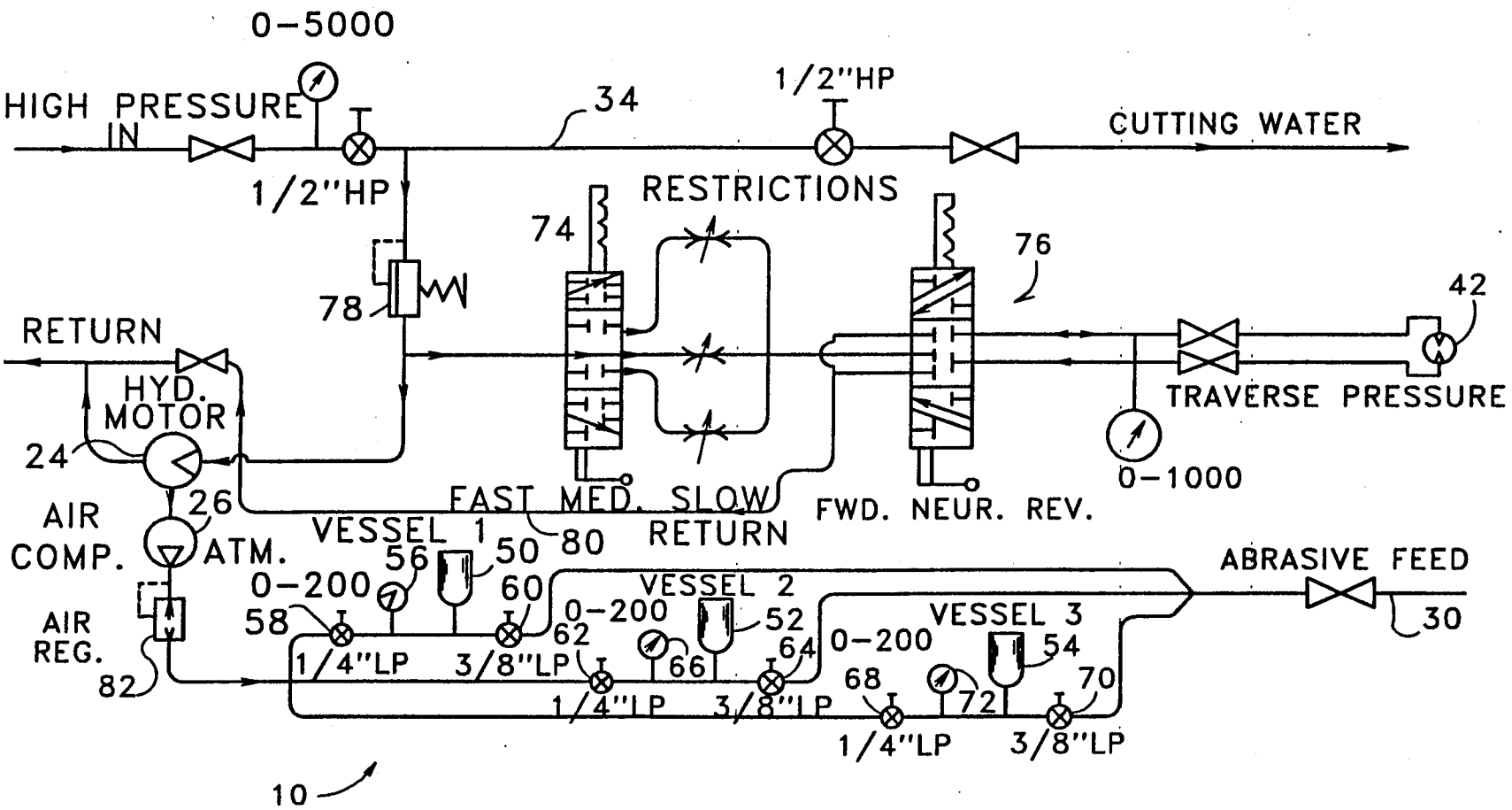
FIG. 3 is a schematic illustration of the hydraulic circuitry for operating the fluid cutting machinery shown in FIG. 1.
Figure 4:
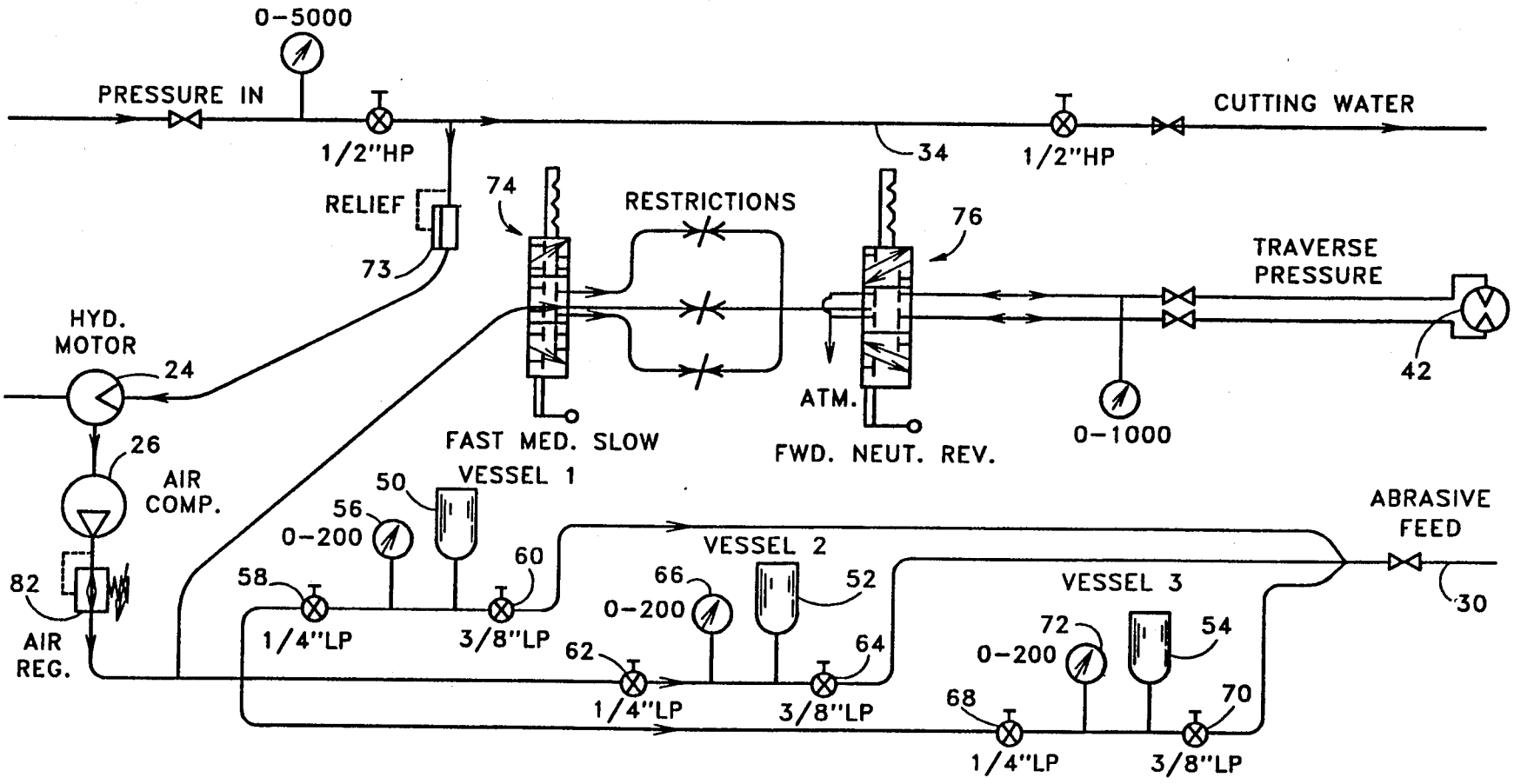
FIG. 4 is a schematic illustration similar to FIG. 2 illustrating a compressed air circuit for operating the fluid cutting machine shown in FIG. 1.

Water at a pressure of approximately 500 p.s.i. is delivered to the motor 42 to actuate the drive train for advancing the nozzle assembly 32 around the pipe as the abrasive water jet stream impinges at 90° upon the pipe 12. The drive motor 42 for the manipulator 40 may also be driven by compressed air rather than water under pressure. FIG. 4 illustrates the embodiment of the present invention in which the manipulator is driven by air from the compressor 26. FIG. 3 illustrates the embodiment in which the manipulator motor 42 is driven by the hydraulic pump 24.

Now referring to FIG. 3, there is illustrated the hydraulic circuitry for controlling operation of the nozzle assembly 32 as well as the manipulator 40. It should be understood that like numerals shown in FIG. 3 designate like parts illustrated and discussed above with respect to FIG. 1. With this arrangement water under pressure is utilized not only to supply a fluid stream at high pressure to the nozzle assembly 32 through conduit 34 but also to actuate the manipulator motor 42 and drive the hydraulic motor 24 used in actuating the air compressor 26 used to pressurize the abrasive particles in vessels 50, 52 and 54. The abrasive particles are delivered under pressure through conduit 30 to the nozzle assembly 32 where the air and abrasives are mixed with water under pressure to form a three phase system. The pressurized air component permits the use of a low to medium water pressure in the range 3000 to 5000 p.s.i. to produce a higher velocity stream than with water alone and generate a cutting action not otherwise available with water alone at this pressure. Thus with the present invention it is possible to achieve a high velocity of abrasives suitable for cutting metal gas well casing at lower water pressures than otherwise available by addition of the pressurized air as another velocity component. The addition of air to the flow of abrasives also provides for a more coherent stream from nozzle assembly 32.

The arrangement shown in FIG. 1 corresponds to the arrangement in FIG. 3 in that the hydraulic motor actuates the air compressor 26 to generate air under pressure through a regulator valve to the pressurized vessel where the abrasive particles are agitated and maintained in suspension by the air under pressure so that the abrasive particles are delivered in a pressurized air stream to the nozzle assembly 32. Conveying the abrasive particle flow under pressure to the assembly 32 adds an additional velocity component to the assembly 32 and serves to maintain a uniform flow rate of abrasives to assembly 32.

In FIG. 1 a single vessel 28 is utilized to maintain the abrasive particles pressurized. In this context the vessel 28 supplies a selected volume of abrasive particles to the nozzle assembly 32. When the vessel 28 has been emptied, it can be removed and another batch of abrasive particles in a second vessel is installed. An alternative method is the utilization of a series of vessels 50, 52 and 54, as shown in FIG. 3. With this arrangement, upon the emptying of vessel 50 of abrasive particles, vessel 52 is brought into operation through valve switching while vessel 50 is being recharged with abrasives.

Once the contents of vessel 52 are consumed, then vessel 54 comes on line and vessel 52 is charged while the abrasive particles are supplied from vessel 54. This permits a continuous operation of the feed of abrasive particles from a source to the cutting jet assembly. The cutting operation need not be interrupted to resupply the vessel with particles.

Positive control of the feeding of the abrasive particles to the cutting jet assembly 32 is obtained by pressurizing the tank or vessel holding the abrasive particles. With the prior art water jet cutting devices, it is the common practice to feed the abrasive to the cutting nozzle by the vacuum created by the flow of the water into the mixing chamber. As a result, the flow of abrasive is not uniform, resulting in ineffective cutting as well as creating a sparking condition. It also requires greater water pressures to achieve the cutting action. Each of the vessels 50, 52, and 54 are charged from the bottom of the vessel where, for example, vessel 50 valve 58 is initially opened and valve 60 maintained closed. This permits air under pressure to enter the tank 50 and to pressurize the tank to a preselected level where the particles within the vessel 50 are maintained in suspension therein.

When the abrasive particles have been pressurized to the degree indicated by a meter 56, valve 58 is opened while valve 60 is maintained open and the abrasive air mixture is conveyed at a uniform rate and volume to the feed line 34 and the cutting jet assembly 32. When the contents of the vessel 50 have been consumed, valves 58 and 60 are closed to permit the utilization of the second pressurized vessel in line. Valves 62 and 64 are operated for vessel 52 in the same manner that valves 58 and 60 are operated to charge the vessel 50. Pressure meter 66 indicates the pressure to which vessel 52 is charged. When the desired pressure level is reached the abrasive particles are then available for feed to the feed line 34. When the contents of vessel 52 are consumed vessel 54 also containing pressurized abrasive particles is brought into operation by the manipulation of valves 68 and 70 as well as pressure meter 72. As both water under pressure and abrasive particles are simultaneously fed to the nozzle assembly 32, the manipulator 40 is actuated for rotation of the entire assembly 32 in a preselected direction around the pipe 12.

The direction of movement and the rate of movement of the manipulator 40 is controlled by a pair of spool valves 74 and 76 or the like. The valves 74 and 76 are connected to the high pressure feed line 34 through pressure relief valve 78. The spool valves 74 and 76 are selectively positioned to control the rate and direction of flow of the fluid under pressure which actuates the hydraulic drive motor 42 for the manipulator 40. With this arrangement the manipulator is rotated around the pipe to be cut at any one of three speeds and in either a forward or reverse direction or maintained stationary. In the neutral position of the spool valve 76 a return of the fluid is provided through conduit 80.

Now referring to FIG. 4, there is illustrated the embodiment in which compressed air is utilized to not only pressurize the vessels 50, 52 and 54 containing the abrasive particles but also to operate the valving associated with the manipulator motor 42. With the arrangement shown in FIG. 4, pressurized fluid flow is directed from the high pressure feed line 34 through the pressure relief valve 78 to the hydraulic pump 24.

As above described, the pump 24 actuates air compressor 26 and a regulator valve 82 is associated with the air compressor 26 in both embodiments in FIGS. 3 and 4. The air regulator valve 82 controls the pressure at which air is conveyed to the vessels 50–54 as well as the spool valves 74 and 76 that control operation of the manipulator motor 42 which, in this embodiment, is operated by compressed air. Thus with the present invention the control of the nozzle assembly 32 and the manipulator 40 may be accomplished by either operation of compressed air or water under pressure. This feature permits the fluid cutting machine 10 to be adapted to the operating conditions that exist, particularly in an underground mine and to be used with equipment serving other other functions in the mine.

Now referring to FIG. 2, there is illustrated in detail the nozzle assembly 32 for combining the flow of abrasive particles and high pressure water flow. As discussed above, the abrasive particles are pressurized within the hopper 28 so that the particles are maintained suspended and in an agitated state. From the hopper 28 the abrasive particles are fed directly to nozzle assembly 32 through the feed line 30. The assembly 32 includes a mounting bracket 84 adapted for connection to the manipulator 40 so that the assembly 32 moves with the manipulator 40 upon actuation of the hydraulic drive motor 42.

A body portion 86 is secured to the bracket 84 and receives at its upper end portion an inlet flange 88 that is adapted to be connected to the high pressure feed line 34 before receiving the pressurized stream of water from the hydraulic pump 24. The inlet flange 88 includes an internal passageway 90 that opens into a mixing chamber 92 formed in the body portion 86. A nozzle jet 94 is threadedly connected to the inlet flange 88 and is radially aligned with the internal passage 90. The nozzle jet 94 extends into the mixing chamber 92. O-ring seals 96 surround the flange 88 within the body portion 86. The body portion 86 also includes an inlet 98 for the pressurized flow of abrasive particles that extends at an angle with respect to the longitudinal axis of the mixing chamber 92. Air inlet 99 also communicates with mixing chamber 92 to generate reduced pressure therein to enhance the flow of abrasives into chamber 92. This arrangement facilitates the thorough admixing of the pressurized stream of abrasive particles and pressurized stream of water. An adaptor 100 is received within the inlet 98 and is connected to the abrasive conduit 30.

As seen in FIG. 2 the extreme end portion of the nozzle jet 94 projects below the point where the inlet 98 communicates with the mixing chamber 92. This further facilitates the thorough admixing of the abrasive particles with the high pressure water stream. Extending below the outlet of the nozzle jet 94 and positioned within the body portion 86 is a transition piece 102, having a conical configuration that serves to narrow the cross-sectional area of the mixing chamber 92. The transition piece 102 receives a cutting tip 104 at its extreme end portion. The cutting tip 104 is connected by a nozzle flange 106 to the body portion 86. In one embodiment the cutting tip 104 has a 0.120" orifice.

From the mixing chamber 92 the abrasive particles are encapsulated in the high pressure water stream where the velocity of the stream is aided by the compressed air flow with the abrasive to the nozzle assembly 32. The stream is coherent and generates higher impact forces than a stream not aided by the compressed air flow of abrasives to the nozzle assembly 32. The abrasive particles are completely surrounded by water. As a result when the particles contact the metal pipe, no heat is generated and no sparking is induced because of the total encapsulation of the particles by the high pressure water stream.

Now referring to FIG. 2A there is illustrated another embodiment of the nozzle assembly 32 which includes a body portion 87 connected by bolts 89 to a mounting bracket 91 of the manipulator 40. The body portion 87 includes a mixing chamber 93 for receiving an inlet flange 95 that includes a passageway 97 for introducing water under pressure into the chamber 93. The flange 95 is peripherally sealed by O-ring 101. A nozzle jet 103 is connected to the flange 95 and extends into passageway 97. Abrasive inlet 105 extends at an angle through the body portion 87 into chamber 93. Positioned oppositely of nozzle jet 103 is a transition piece 107 having a conical passageway connected to cutting tip 109 that is supported by the body portion 87 and extends therefrom. The three phase mixture of compressed air, abrasive particles, and pressurized water is conveyed into the mixing chamber 93 for mixing and is conveyed as an abrasive particle jet stream from cutting tip 109 in a coherent stream.

With the above described arrangement of the cutting jet assembly 32, an 8" steel pipe having a thickness of ⅜" is severed in a period of time from 10 to 16 minutes where the consumption rate of abrasive particles is about 7 lbs. per minute for water jet pressure in the range between about 3,000 to 4,000 p.s.i. The composition of the abrasive particles is selective. Abrasive particles for use with the present invention include copper slag, quartz, garnet, and industrial sand Tilcon 16/30. The particles may include various combinations of mesh sizes. The following examples of a suitable combination of mesh sizes for copper slag is given below:

EXAMPLE 1

| Mesh Size | Percentage |
|---|---|
| less than 14 m to 28 m | 28.50 |
| less than 28 m to 42 m | 33.20 |
| less than 42 m to 80 m | 21.66 |
| less than 80 m | 16.64 |
| | 100.00 |

EXAMPLE 2

| Mesh Size | Percentage |
|---|---|
| less than 14 m to 28 m | 29.75 |
| less than 28 m to 48 m | 66.00 |
| less than 48 m | 4.25 |

-continued

| Mesh Size | Percentage |
|---|---|
| | 100.00 |

With the above size distribution of copper slag as the abrasive material, 7 to 8 gallons per minute of water and 7 to 8 lbs. of abrasive material are consumed for 1 to 1 ratio of flow rate of water to a volume by weight of abrasive material. The air consumption is 8–10 standard cubic feet per minute. It should also be understood that the present invention may be operated on a two phase system in which only compressed air and pressurized water are conveyed to the nozzle 104. With this embodiment the abrasive particles are not utilized. The addition of air to the water permits the use of lower water pressures than normally used for cutting operations by water only, i.e., pressure much less than 10,000 p.s.i. Such uses are found in cutting printed circuit boards and thin films.

Now referring to FIGS. 5 and 6, there is illustrated one embodiment of the manipulator 40 for advancing the nozzle assembly 32 in a circumferential path around the pipe 12. In order to maintain a uniform distance between the tip of the nozzle 104 and the outer surface of the pipe 12, the manipulator 40, including the hydraulic drive motor 42, is movably supported on the pipe 12 by a follower arm 108, having the configuration of a collar with a surface that corresponds substantially to the diameter of the pipe 12 and includes at an outer end a follower portion 110 that is maintained in contact with the surface of the pipe 12.

Figure 6A:
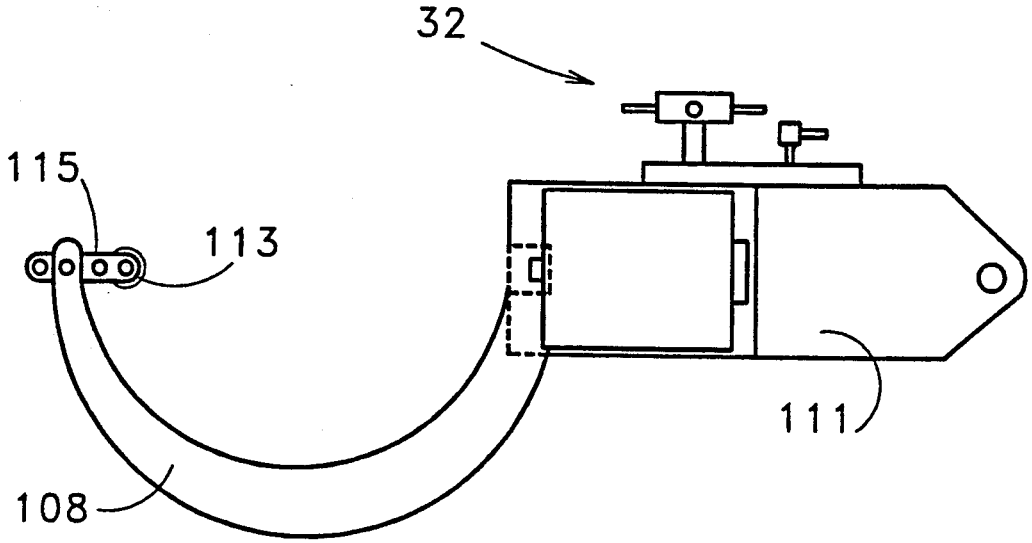
FIG. 6A is a plan view of one embodiment of the mounting assembly for the manipulator shown in FIGS. 5 and 6.
Figure 6B:
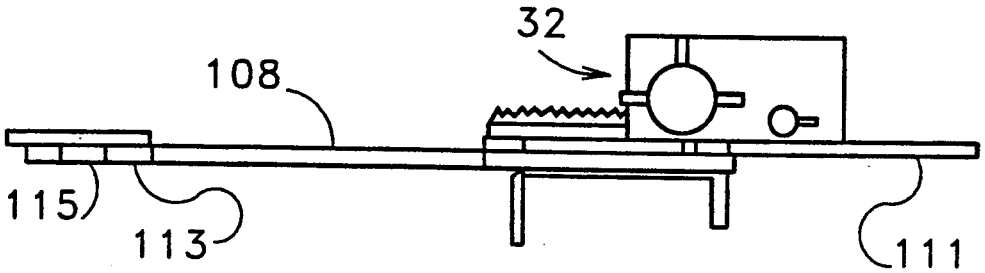
FIG. 6B is a view in side elevation of the mounting assembly shown in FIG. 6A.

Another embodiment of the follower 108 is shown in FIG. 6A in which one end thereof is secured to a mounting plate 111 and a follower wheel 113 is connected by an adjustment strap 115 to the other end of follower 108. This arrangement permits adjustments to engage pipes of different diameter and also pipes which are out of round. With both embodiments of the follower arm 108 contact is maintained with the surface of the pipe oppositely of the nozzle 104. If there are any variations in the surface configuration of the pipe 12 contact of the guide portion 112 with the pipe maintains the nozzle 104 a fixed distance from the surface of the pipe 12.

Figure 6C:
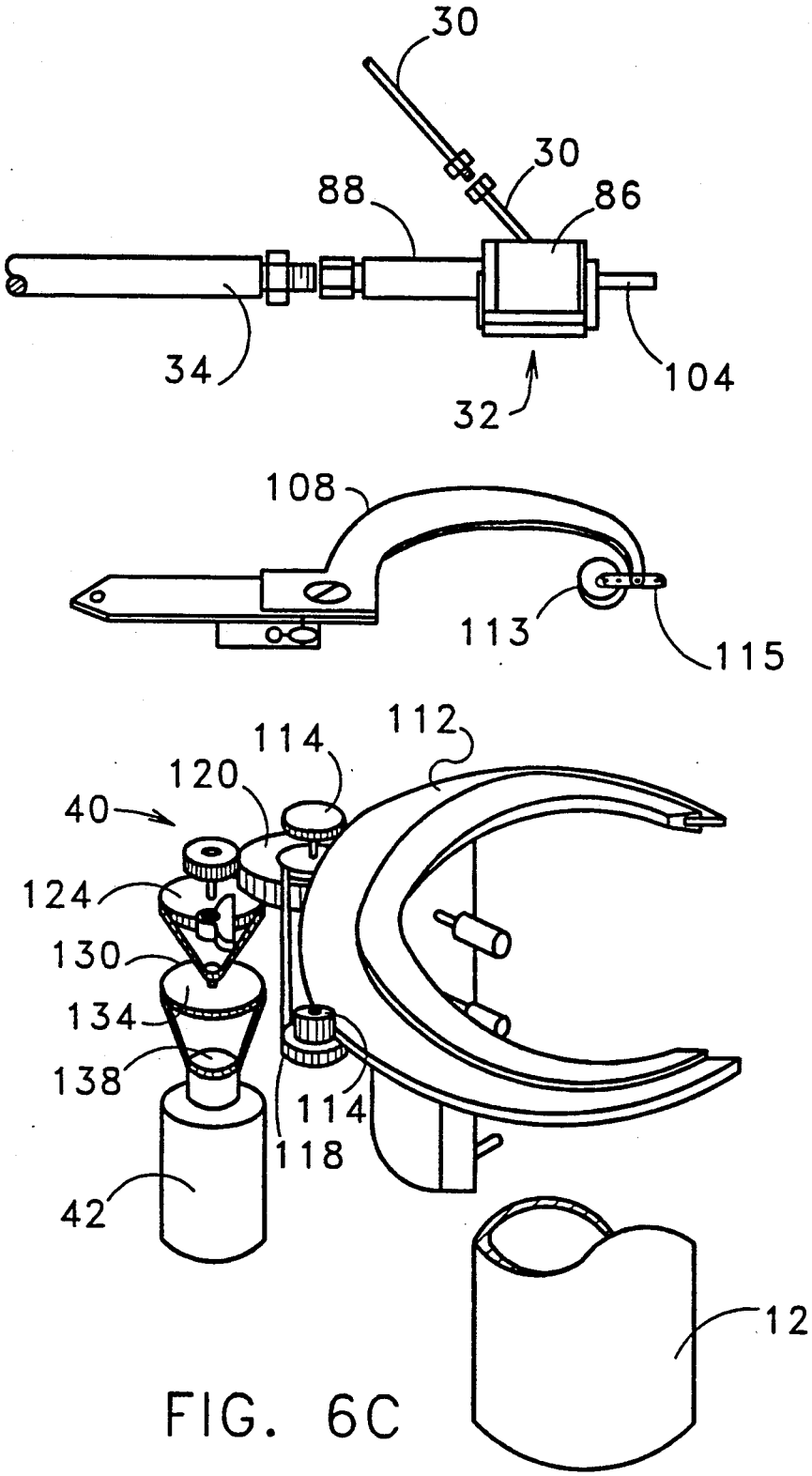
FIG. 6C is an exploded view of the manipulation, mounting assembly and nozzle assembly.

The follower arm 108 is bolted to a large gear segment 112 as shown in FIGS. 5, 6 and 6C. The periphery of the gear segment 112 meshes with a pair of sprockets 114 in a manner to advance segment 112. The sprockets 114 are connected by a chain 116. Sprockets 114 are connected to a pair of sprockets 118 which are in turn drivingly connected by a chain 116. The pair of sprockets 118 and 120 serve as an equalizer for the total drive system. Coaxially mounted with one of the sprockets 118 is a sprocket 120 mounted on the shaft 122. Also mounted on shaft 122 displaced from sprocket 120 is a sprocket 124 connected by chain 126 to sprocket 130 on shaft 132. Shaft 132 also supports sprocket 134 which is drivingly connected by chain 136 to sprocket 138 on output shaft 140 of the hydraulic motor 42. With this arrangement rotation generated by the output shaft 146 is transmitted to the large gear segment 112 which advances around the periphery of the pipe 12 with the guide portions 108, 115 and 113.

Now referring to FIGS. 7–10, there is illustrated a second embodiment of the manipulator for supporting the cutting jet assembly 32 in a preselected position with respect to the outer surface of the pipe 12. This embodiment also permits the cutting jet assembly 32 to be supported on flat surfaces for cutting along a prescribed path. The body portion 86 of the cutting jet assembly 32 includes an outwardly extending flange 142 that is connected by a bolt 144 to an adjacent flange 146 that is in turn connected to a frame 148 for supporting a plurality of rollers 150 that ride upon the outer surface of the pipe 12. The rollers 150 are arranged in pairs and are positioned oppositely of one another. In another arrangement, flange 91 as shown in FIG. 2A is fastened directly by a set of bolts presently shown in FIG. 9 attached to flange 146 for a more rigid mounting.

A lug 152 extends outwardly from the frame 148 and a spring biased bolt 154 extends through the lug 152 and into engagement with an opposite lug 156 that is connected to a sprocket 158. The sprocket 158 is in turn mounted on output shaft 160 of the hydraulic drive motor 42. A chain 162 is supported by the sprocket 158 and extends around and in contact with the periphery of the pipe 12. With this arrangement, upon rotation of the sprocket 158 and actuation of the motor 42 the frame 148 is carried around the pipe 12 to in turn advance the cutting jet assembly 32 around the pipe 12. The rollers 150 are adjusted by advancement of the bolt 154 on the lugs 152 and 156.

Advancement of the bolt 154 away from the pipe 12 lowers the rollers out of engagement with the surface of the pipe 12 to disengage the chain from driving engagement with the pipe 12. When the rollers 150 are in frictional engagement with the surface of the pipe 12, the motor 42 and assembly 86 are stabilized so that upon rotation of the chain 162 the tip of the nozzle 104 is maintained a fixed distance from the surface of the pipe 12 during the cutting action.

According to the provisions of the Patent Statutes, I have explained the principle, preferred construction and mode of operation of my invention and have illustrated and described what I now consider to represent is best embodiments. However, it should be understood that, within the scope of the appended claims, the invention may be practiced otherwise than as specifically illustrated and described.

I claim:

1. Apparatus for severing metal casing comprising, a supply of abrasive particles, a vessel for storage of the abrasive particles, said vessel having an inlet at the bottom of said vessel for receiving air under pressure to pressurize said vessel to a preselected level to suspend the abrasive particles in said vessel, said vessel inlet serving as an outlet for discharging from the bottom of said vessel the abrasive particles entrained in a pressurized air stream, a source of water under pressure, a nozzle assembly positioned adjacent the metal casing to be severed, said nozzle assembly having a first inlet for receiving the abrasive particles entrained in said pressurized air stream, a second inlet for receiving a flow of the pressurized water, a mixing chamber, an outlet nozzle for discharging the abrasive particles encapsulated in the flow of pressurized water to form an abrasive cutting stream, manipulator means for mounting said nozzle assembly for rotation at a controlled rate around the casing as said abrasive cutting stream impacts the surface of the casing, means for charging said vessel with compressed air through said vessel inlet to maintain the abrasive particles suspended under pressure within said vessel wherein the abrasive particles have a size capable of maintaining substantially all the particles in said vessel in suspension by the air under pressure, and conduit means for controlling the flow of the abrasive particles entrained in said pressurized air stream from said vessel inlet through said nozzle assembly inlet to said mixing chamber for mixture with the pressurized water and discharge from said outlet nozzle as said abrasive cutting stream upon the metal casing.

2. Apparatus as set forth in claim 1 which includes, means for injecting compressed air into said inlet at the bottom of said vessel where the abrasive particles are discharged to maintain the particles in suspension in said vessel, and valves at said inlet for controlling the flow of compressed air to said vessel to charge the abrasive particles to a preselected pressure and thereafter permit the flow of the abrasive particles entrained in compressed air from said vessel at a preselected rate of flow.

3. Apparatus as set forth in claim 1 which includes, pump means for conveying water under pressure in a range between about 3000 to 5000 p.s.i. to said nozzle assembly second inlet.

4. Apparatus as set forth in claim 3 which includes, an air compressor for charging said vessel with compressed air, and said pump means connected to said air compressor for actuating said air compressor.

5. Apparatus as set forth in claim 1 which includes, means for maintaining said vessel continuously charged with compressed air to maintain the abrasive particles in suspension at said vessel inlet to insure a steady state flow of the abrasive particles entrained in the compressed air stream from said vessel.

6. Apparatus as set forth in claim 1, which includes, means for maintaining said outlet nozzle at a preselected distance from the surface of the metal casing as said nozzle assembly is rotated around the metal casing and said abrasive cutting stream impacts the metal casing to cut through the metal casing and sever the metal casing at the point opposite said outlet nozzle.

7. Apparatus as set forth in claim 1 which includes, valve means connecting said source of water under pressure with said manipulator means for actuating rotation of said nozzle assembly in a preselected rotational direction and rate of rotation around the metal casing.

8. Apparatus as set forth in claim 1 in which, said nozzle assembly first inlet includes a jet projecting into said mixing chamber in axial alignment therewith, and said nozzle assembly second inlet projecting at an angle into said mixing chamber relative to said first inlet and displaced axially therefrom so that the abrasive particles enter said mixing chamber at a point removed from the point where the pressurized water enters said mixing chamber.

9. Apparatus as set forth in claim 1 in which, the abrasive particles include copper slag of a mesh size in the range between about 14M to 28M of at least 28% by volume of the abrasive particles.

10. Apparatus as set forth in claim 1 in which, the ratio of the volume flow rate of the pressurized water feed to said nozzle assembly to weight of abrasive particles consumed in said abrasive cutting stream is one to one.

11. A method for cutting metal pipe comprising the steps of, storing a supply of abrasive particles in a vessel, injecting compressed air through an inlet at the bottom of the vessel to pressurize the abrasive particles having a preselected size capable of being suspended in air to form a suspension of the abrasive particles in compressed air, maintaining the supply of abrasive particles in suspension by the compressed air, conveying the abrasive particles entrained in a stream of compressed air from the inlet at the bottom of the vessel to a mixing nozzle, conveying a stream of pressurized water to the mixing nozzle, mixing the pressurized water stream and abrasive particles entrained in compressed air in the mixing nozzle, discharging from the mixing nozzle the compressed air stream of abrasive particles encapsulated in the stream of pressurized water to form an abrasive cutting stream, and directing the abrasive cutting stream upon the metal pipe to impact the metal pipe with a force to cut the pipe.

12. A method as set forth in claim 11 which includes, introducing compressed air into a vessel containing the abrasive particles at the location in the vessel where the particles are discharged from the vessel to maintain the abrasive particles in suspension for a steady state flow to the mixing nozzle.

13. A method as set forth in claim 11 which includes, introducing the pressurized water stream and abrasive particles entrained in compressed air at axially displaced positions and at a relative angle into the mixing nozzle.

14. A method as set forth in claim 11 which includes, maintaining the mixing nozzle a preselected distance from the surface of the metal pipe, and rotating the mixing nozzle around the metal pipe at a preselected rate with respect to the flow rate of the abrasive cutting stream from the mixing nozzle to cut the metal pipe in a peripheral direction thereabout to sever the pipe.

15. A method as set forth in claim 11 which includes, directing the abrasive cutting stream upon the metal pipe at a location positioned remote from the location where the abrasive particles are charged with compressed air.

16. A system for supplying a flow of abrasive particles entrained in a compressed air stream and water under pressure comprising, a source of abrasive particles of a preselected size, conduit means for supplying air under pressure in a first direction to said source of abrasive particles to suspend the abrasive particles in air, valve means in said conduit means for directing the abrasive particles entrained in a compressed air stream from said source through said conduit means in a second direction opposite to the direction of flow of the air to said source, a housing having a nozzle inlet, a second inlet, a nozzle outlet, and a chamber connecting said first and second inlets with said nozzle outlet, a source of pressurized water connected to said nozzle inlet for supplying pressurized water to said chamber, said conduit means connected to said second inlet, said chamber receiving from said second inlet the stream of abrasive particles intrained in compressed air for encapsulation with the pressurized water and delivery to said nozzle outlet, and a stream of the abrasive particles encapsulated in the pressurized water directed from said nozzle outlet where the compressed air and pressurized water combine to accelerate the abrasive particles to a flow rate for cutting metal objects free of sparking.

17. A system as set forth in claim 16 in which, said nozzle inlet receiving the pressurized water is axially aligned with said nozzle outlet for discharging the water encapsulated pressurized stream of abrasive particles, and said second inlet being angularly displaced from said nozzle inlet and axially removed therefrom.

18. A system as set forth in claim 16 in which, said nozzle outlet narrows in diameter from said chamber to the point where the abrasive particles are discharged from said nozzle outlet to accelerate the flow of the abrasive particles.

19. A spark-free abrasive cutting system comprising, a source of abrasive particles, means for admixing the abrasive particles with a compressed air stream to place the abrasive particles in suspension, conduit means for conveying from said source the abrasive particles in suspension and entrained in a stream of compressed air, a housing having a nozzle inlet, a second inlet, a nozzle outlet, and a chamber connecting said nozzle inlet and said second inlet with said nozzle outlet, said nozzle inlet being positioned downstream of said second inlet in said chamber, said source of a compressed air stream with entrained abrasive particles connected to said second inlet, said compressed air stream with entrained abrasive particles being accelerated as it passes through said second inlet into said chamber, a source of pressurized water connected to said nozzle inlet for supplying pressurized water to said chamber at a point in said chamber downstream of said second inlet, said chamber receiving the accelerated compressed air stream with entrained abrasive particles and said pressurized water for mixing to encapsulate the abrasive particles by the flow of pressurized water through said nozzle inlet for delivery to said nozzle outlet, and said nozzle outlet accelerating the pressurized water at a flow rate enhanced by the presence of the compressed air to form a water encapsulated abrasive stream for contact with metal pipe to cut the pipe in the absence of generating heat to prevent sparking.

* * * * *